US011688970B2

(12) United States Patent
Rayburn et al.

(10) Patent No.: US 11,688,970 B2
(45) Date of Patent: Jun. 27, 2023

(54) CABLE CONNECTOR HAVING OVER-MOLDED STRAIN RELIEF MEMBER FORMED FROM ELECTRICALLY CONDUCTIVE MATERIAL

(71) Applicant: Molex, LLC, Lisle, IL (US)

(72) Inventors: Andrew Rayburn, Maumelle, AR (US); Gianni Bardella, Maumelle, AR (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 17/521,861

(22) Filed: Nov. 9, 2021

(65) Prior Publication Data

US 2022/0069514 A1 Mar. 3, 2022

Related U.S. Application Data

(63) Continuation of application No. 16/632,540, filed as application No. PCT/US2018/043226 on Jul. 23, 2018, now Pat. No. 11,211,742.

(60) Provisional application No. 62/536,014, filed on Jul. 24, 2017.

(51) Int. Cl.

| | |
|---|---|
| ***H01R 13/58*** | (2006.01) |
| ***H01B 11/00*** | (2006.01) |
| ***H01R 12/53*** | (2011.01) |
| ***H01R 13/6581*** | (2011.01) |

(52) U.S. Cl.

CPC ..... *H01R 13/5845* (2013.01); *H01B 11/002* (2013.01); *H01R 12/53* (2013.01); *H01R 13/6581* (2013.01)

(58) Field of Classification Search

CPC ..... H01R 13/5845; H01R 13/6581; H01R 12/53; H01B 11/002

USPC ..... 439/604

See application file for complete search history.

(56) References Cited

U.S. PATENT DOCUMENTS 4,846,724 A * 7/1989 Sasaki ..... H04B 15/00 439/607.41

5,364,292 A 11/1994 Bethurum 5,691,506 A 11/1997 Miyazaki et al.

(Continued)

FOREIGN PATENT DOCUMENTS

CN 2548285 Y 4/2003

CN 2582223 Y 10/2003

(Continued)

OTHER PUBLICATIONS

First Office Action and Search Report received for CN application No. 201880042311.0, dated Oct. 10, 2020, 18 pages. (10 pages of English translation and 8 pages of Official copy).

(Continued)

*Primary Examiner* — Peter G Leigh

(57) ABSTRACT

The present disclosure provides a cable connector assembly that includes a cable having conductors secured to contact pads formed on a printed circuit board. A housing and cover are configured to be secured together and combine to form a cavity for receiving the printed circuit board and the cable. A slug is formed around a portion of the cable. Upon assembly of the cover to the housing, the slug is disposed in a pocket formed in the cavity and helps secure the cable to the housing and cover.

18 Claims, 11 Drawing Sheets

(56) References Cited

U.S. PATENT DOCUMENTS

| | | | | |
|---|---|---|---|---|
| 5,716,229 | A * | 2/1998 | Loder | H01R 12/774 439/495 |
| 6,869,308 | B2 * | 3/2005 | Wu | H01R 13/6589 439/497 |
| 7,029,290 | B2 * | 4/2006 | Wu | H01R 13/65912 439/76.1 |
| 7,179,117 | B2 * | 2/2007 | Wu | H01R 13/5845 439/460 |
| 7,226,316 | B2 * | 6/2007 | Wu | H01R 13/6275 439/484 |
| 7,442,072 | B2 | 10/2008 | Droesbeke et al. | |
| 7,485,013 | B2 | 2/2009 | Kuo | |
| 7,534,125 | B1 | 5/2009 | Schroll | |
| 7,922,520 | B2 * | 4/2011 | Mizukami | H01R 13/65912 439/493 |
| 8,202,122 | B2 * | 6/2012 | Wu | H01R 13/6581 439/352 |
| 8,333,616 | B2 | 12/2012 | Su et al. | |
| 8,348,681 | B2 * | 1/2013 | Phillips | G02B 6/4284 439/99 |
| 8,834,197 | B2 | 9/2014 | Wu et al. | |
| 9,310,572 | B2 * | 4/2016 | Keenum | G02B 6/4478 |
| 9,373,915 | B1 * | 6/2016 | Schulz | H01R 13/6461 |
| 9,425,562 | B2 * | 8/2016 | Blazek | H01R 13/6592 |
| 9,523,829 | B2 * | 12/2016 | Keenum | G02B 6/428 |
| 9,590,363 | B2 * | 3/2017 | Wu | H01R 13/6585 |
| 9,610,905 | B2 * | 4/2017 | Choi | B60R 16/023 |
| 2004/0147167 | A1 | 7/2004 | Lai | |
| 2008/0305658 | A1 | 12/2008 | Ko | |
| 2009/0227133 | A1 | 9/2009 | Zhang et al. | |
| 2011/0255830 | A1 | 10/2011 | Phillips | |
| 2012/0028496 | A1 | 2/2012 | Su | |
| 2014/0241674 | A1 * | 8/2014 | Isenhour | G02B 6/428 29/829 |
| 2016/0079714 | A1 | 3/2016 | Wu | |

FOREIGN PATENT DOCUMENTS

| | | | | |
|---|---|---|---|---|
| CN | 2874838 | Y | 2/2007 | |
| CN | 2891361 | Y | 4/2007 | |
| CN | 201038510 | Y | 3/2008 | |
| CN | 101542844 | A | 9/2009 | |
| CN | 102570081 | A | 7/2012 | |
| CN | 202333267 | U | 7/2012 | |
| CN | 105142909 | A * | 12/2015 | B41J 2/045 |
| CN | 205303805 | U | 6/2016 | |
| EP | 2764388 | B1 * | 8/2016 | G02B 6/3887 |
| JP | H11111391 | A | 4/1999 | |
| TW | 201103211 | A | 1/2011 | |
| TW | M425437 | U | 3/2012 | |
| WO | 2019023094 | A1 | 1/2019 | |

OTHER PUBLICATIONS

International Preliminary report on patentability received for PCT application No. PCT/US2018/043226, dated Feb. 6, 2020, 8 pages.
International Search Report and written opinion received for PCT application No. PCT/US2018/043226, dated Nov. 8, 2018, 9 pages.
Office Action received for CN Application No. 201880042311.0, dated Jun. 4, 2021, 10 pages. (05 pages of English Translation and 05 pages of Official Notification).

* cited by examiner

CABLE CONNECTOR HAVING OVER-MOLDED STRAIN RELIEF MEMBER FORMED FROM ELECTRICALLY CONDUCTIVE MATERIAL

CROSS-REFERENCE TO RELATED APPLICATIONS

This application is a continuation of U.S. Ser. No. 16/632,540, filed Jan. 21, 2020, now U.S. Pat. No. 11,211,742, which claims the benefit of and priority to International Application No. PCT/US2018/043226, filed Jul. 23, 2018, both of which are incorporated herein by reference in their entirety and which further claims the benefit of and priority to U.S. Provisional Application No. 62/536,014, filed Jul. 24, 2017.

FIELD OF THE INVENTION

The current disclosure relates to the field of cable connectors and, in particular, to cable connectors having a strain relief mechanism.

BACKGROUND

The current disclosure generally relates to a cable connectors having a strain relief mechanism. Strain reliefs are used specifically incorporated into cable connectors to absorb and transfer stress due to bending and tensile forces away from the cable to connector interface. Increased stress in these areas damage the connector and cable which can lead to the conductor breakage and the separation of the actual conductors of the cable from the connector.

In general, additional plastic or rubber members are added to the cable to cable connector interface, typically called boots. These boots prevent over-bending of the cable at the interface and also transfer incidental pulling forces applied to the cable to the connector housing. This essentially removes any forces from being transfer from the conductors of the cable to the actually connection terminals or contacts within the connector housings. The boots are typically formed as a separate operation when manufacturing the cable connector and are unique to each cable connector. Certain individuals can appreciate a cost effective and standardized solution to this problem.

BRIEF SUMMARY

According to an embodiment of the disclosure, a cable connector system is provided that includes a cable connector having a latching mechanism, and a receptacle connector configured to mate with the cable connector and be securely retained by a latching mechanism. The latch mechanism is integrated into the cable connector and includes an integrated pull member that operates a locking hook. By grasping the pull, an actuation member formed in the pull deflects the locking member out of engagement with a retention member formed on the receptacle.

In an embodiment of the cable connector system, the cable connector or plug connector includes a housing and a cover having a circuit board positioned therein. A cable, including multiple individual cable portions, is disposed in the housing with individual conductors of the cable portions electrically connected to appropriate connection pads formed on the circuit board which are encapsulated with an epoxy layer. An over-molded strain relief member is disposed at the interface between the cable and the housings and is integrally secured to the cable. The over-molded strain relief is formed from an electrically conductive material and is configured to interlock with the housing and cover to secure it therein and provide a grounding path between the cable and the housing and cover.

BRIEF DESCRIPTION OF THE DRAWINGS

The present invention is illustrated by way of example, and not limited, in the accompanying figures in which like reference numerals indicate similar elements and in which.

DETAILED DESCRIPTION

The appended figures illustrate an embodiment of the cable connector, and it is to be understood that the disclosed embodiments are merely exemplary, which may be embodied in various forms. Therefore, specific details disclosed herein are not to be interpreted as limiting, but merely as a basis for the claims and as a representative basis for teaching one skilled in the art to variously employ the present disclosure.

Figure 1:
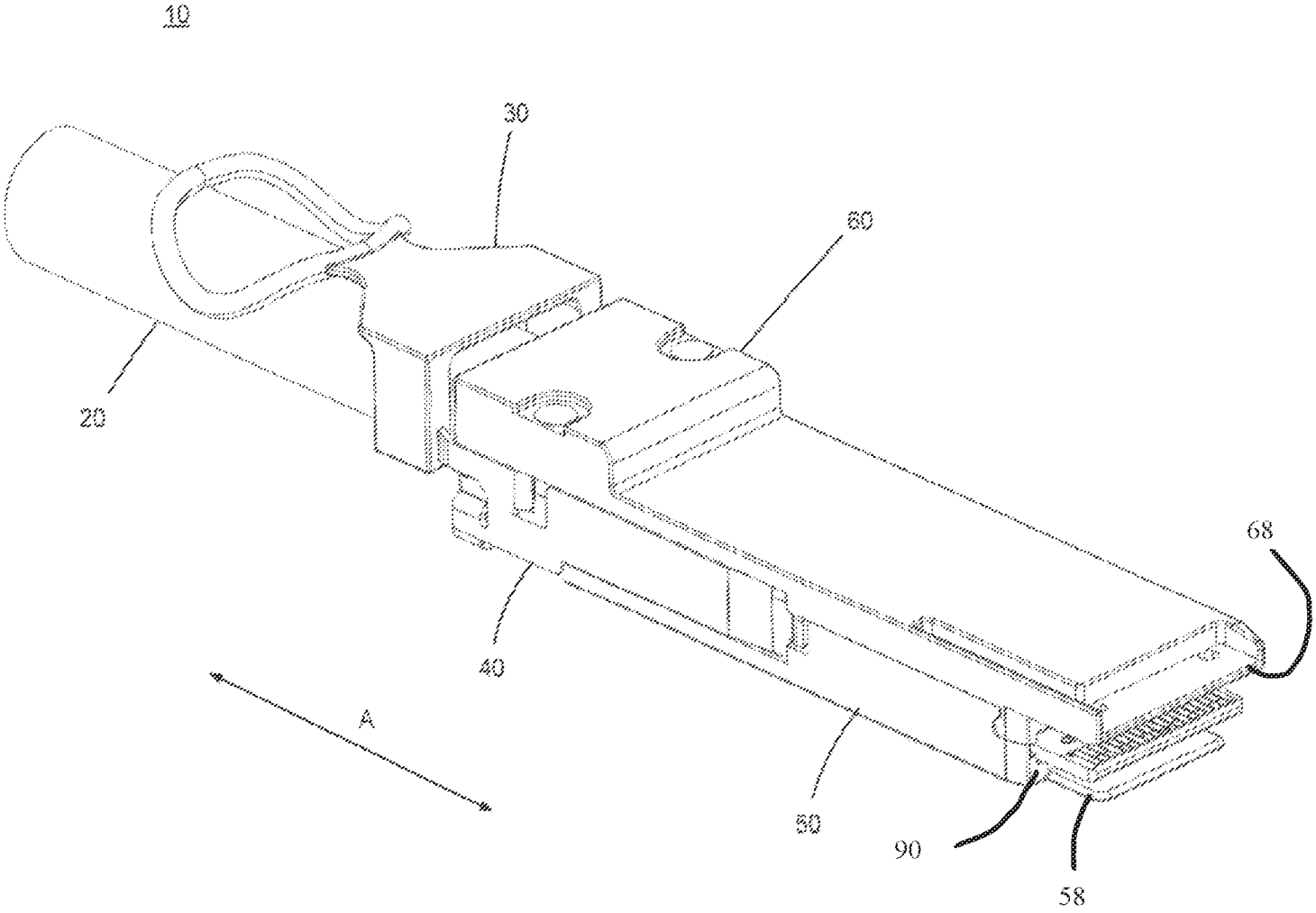
FIG. 1 is a perspective view of the cable connector.
Figure 2:
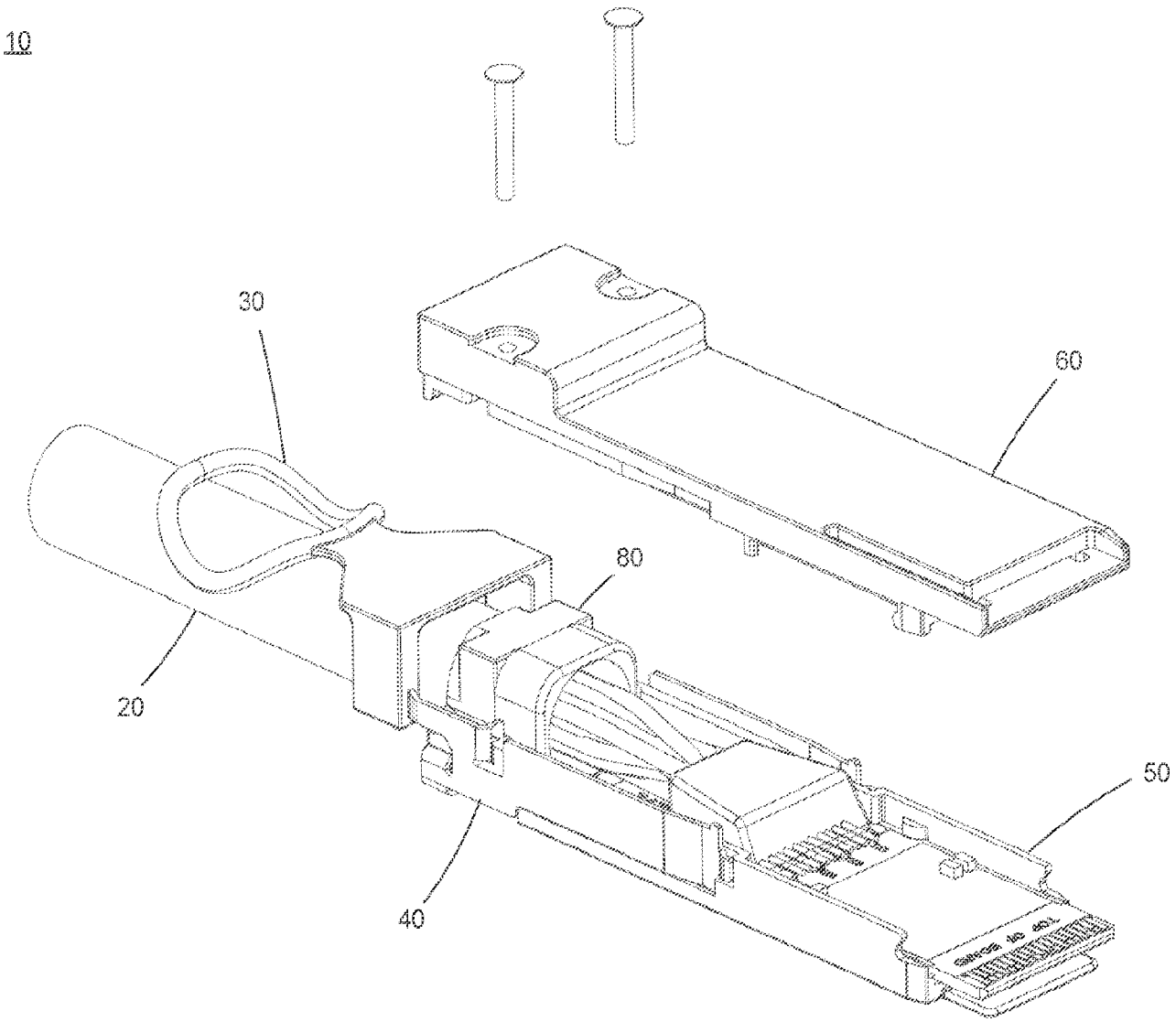
FIG. 2 is a partial exploded view of the cable connector of FIG. 1.
Figure 3:
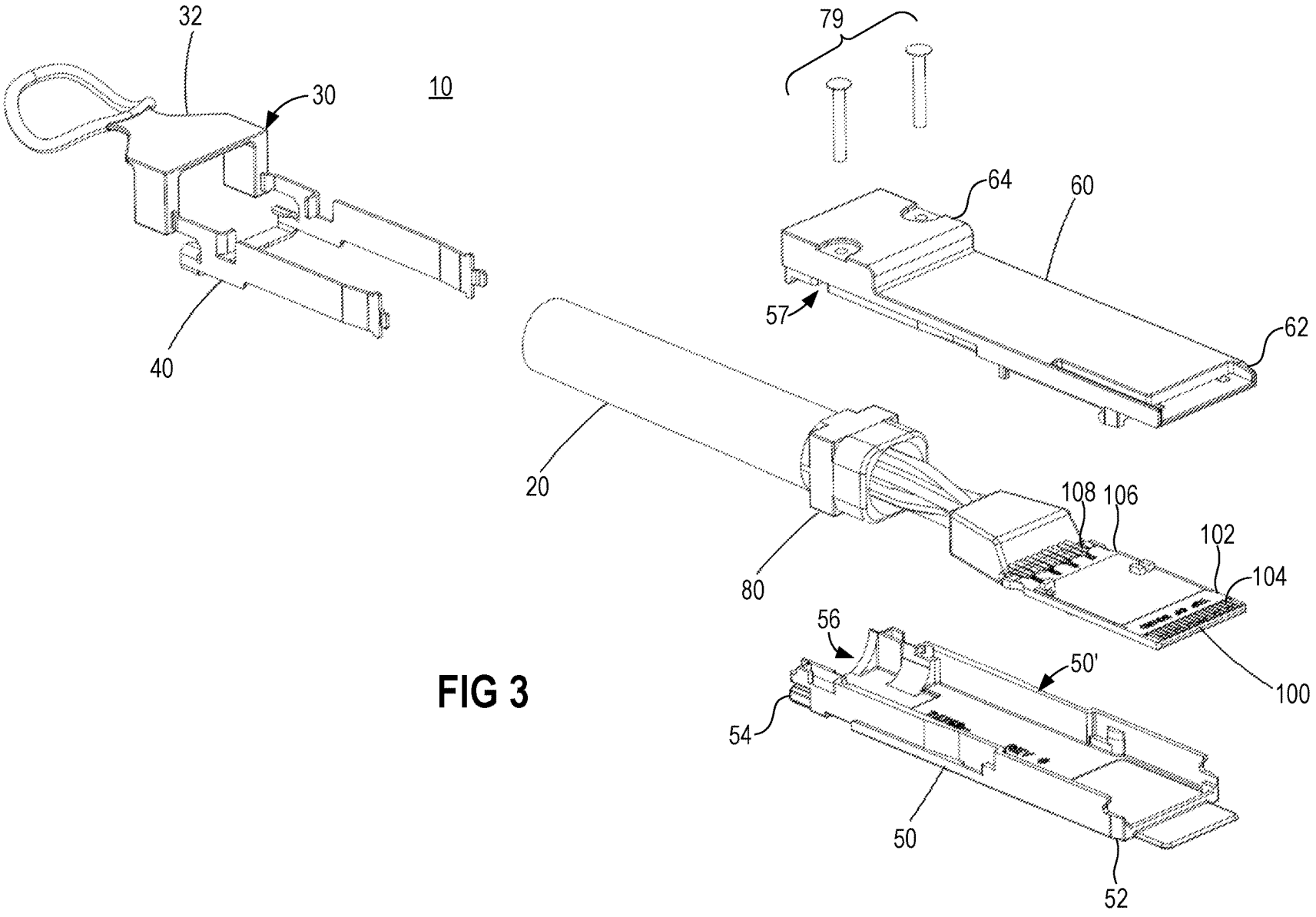
FIG. 3 is an exploded view of the cable connector of FIG. 1.

As best shown in FIG. 1-3, an embodiment of the cable connector 10 includes a housing 50 and a cover 60, where the housing 50 and the cover 60 are operatively connected together define a cavity. In the embodiment shown, the housing 50 and the cover 60 are die cast and made from a conductive material such as aluminum, but alternative materials can be used. A circuit board 100 is disposed in the cavity, the circuit board 100 having a first end 102 defining a mating portion and including a plurality of contact pads 104, and a second end 106 electrically connected to the conductors of a cable 20. As can be appreciated, the mating portion extends forward of a front face 90 and can be protected by a flange 58 of the housing 50 and a flange 68 of the cover 60. A dispensed epoxy layer 110 covers the electrical connection portion of the cable 20 and the circuit board 100. An over-molded slug 80 is disposed on the cable 20 and is fitted to the housing 50 and the cover 60, creating an integral strain relief between the cable 20 and the housing 50 and the cover 60. A latching mechanism 30 includes a locking member 40 and pull member 32 that are movably attached to the housing 50 and the cover 60 that allow the cable connector 10 to be securely locked to a receptacle (not shown).

FIG. 3 illustrates the cable connector 10 that includes a housing 50 formed from a conductive material such as aluminum, and includes a mating end 52 and a connecting end 54. A cover 60, similarly having a mating end 62 and a connecting end 64, is configured to be operatively secured to the housing 50. The housing 50 and the cover 60 are secured by a cooperating hook and catch formed on respective ones of the housing 50 and cover 60 and a pair of rivets 79 or screws positioned near the securing end of the housing 50 and cover 60.

The housing 50 and cover 60, upon assembly, cooperatively form an internal cavity. The mating ends 52, 62 of the housing 50 and cover 60 are configured to engage a second connector (not shown). The rear portions of the housing 50 and cover 60 are configured to securely hold a cable.

As further illustrated in FIG. 3, the plug connector is provided with components, including a cable assembly 20 and a circuit board 100. The cable assembly 20, as best shown in FIG. 4, includes a plurality of differential pair conductors 82.

Figure 4:
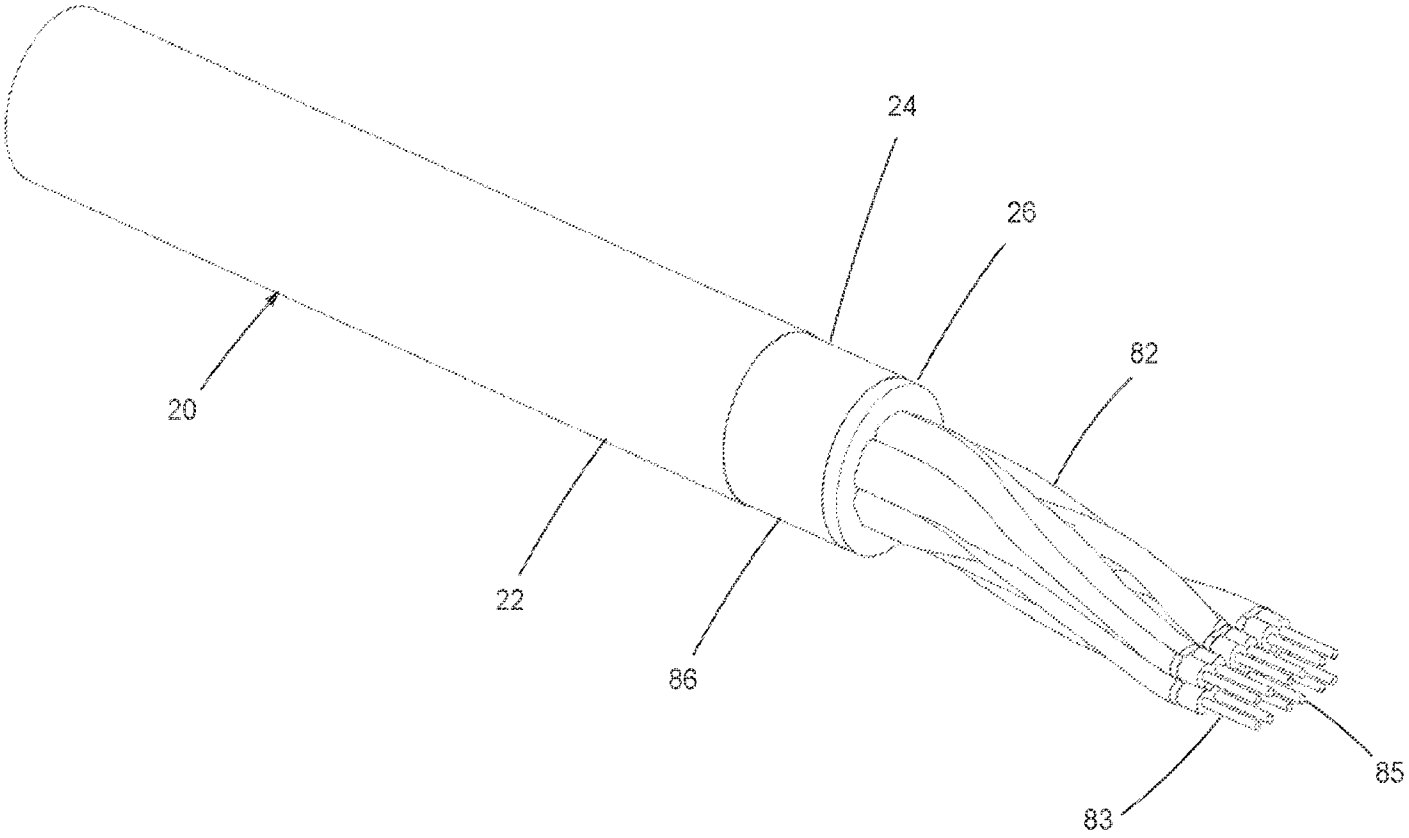
FIG. 4 is a perspective view of the conductive cable of FIG. 3.
Figure 5:
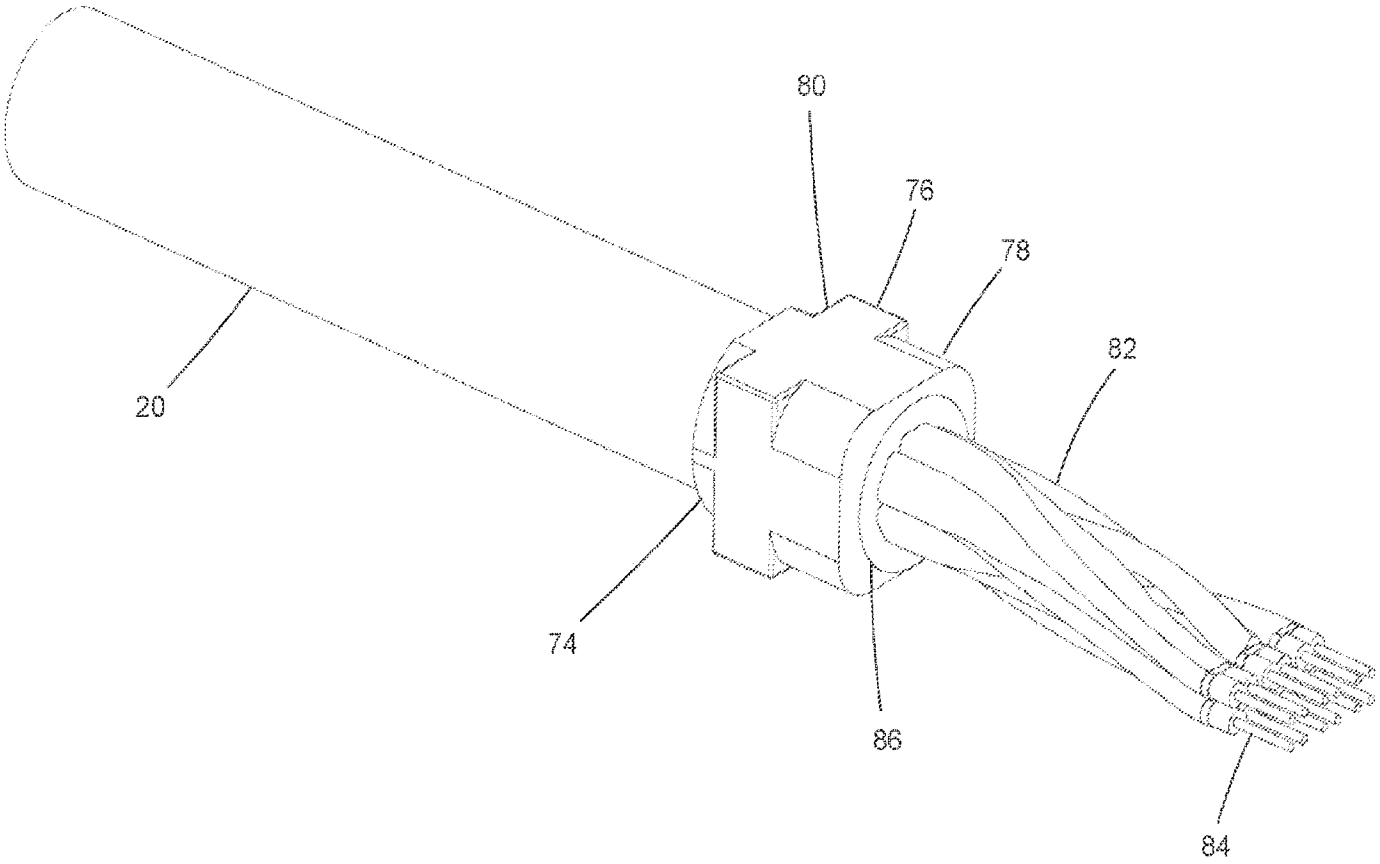
FIG. 5 is a perspective view of the conductive cable of FIG. 4 with strain relief.

As best shown in FIG. 4, the cable assembly 20 includes a plurality of individual differential pair cable portions 82 surrounded by an insulative outer jacket 22. In the embodiment shown, a bundle of Twin Axial, "Twinax" cables 82 are surrounded by an inner jacket or alternative insulator 26 and a shielding layer 24, typically a braid, mesh, or foil, that is disposed between the inner and outer jacket. Each individual differential pair cable portion 82 includes a pair of conductors 83 and a drain wire or foil surrounded by an insulative jacket. Other types of differential pair cables can be used such as a shielded twisted pair can be appreciated. In the embodiment shown, the cable assembly 20 is built during the assembly of the plug connector. The individual differential pair cable conductors are first provided and wrapped with the shielding layer and finished with an expandable jacket. In alternative embodiments, the entire cable assembly is provided as a single component.

Figure 6:
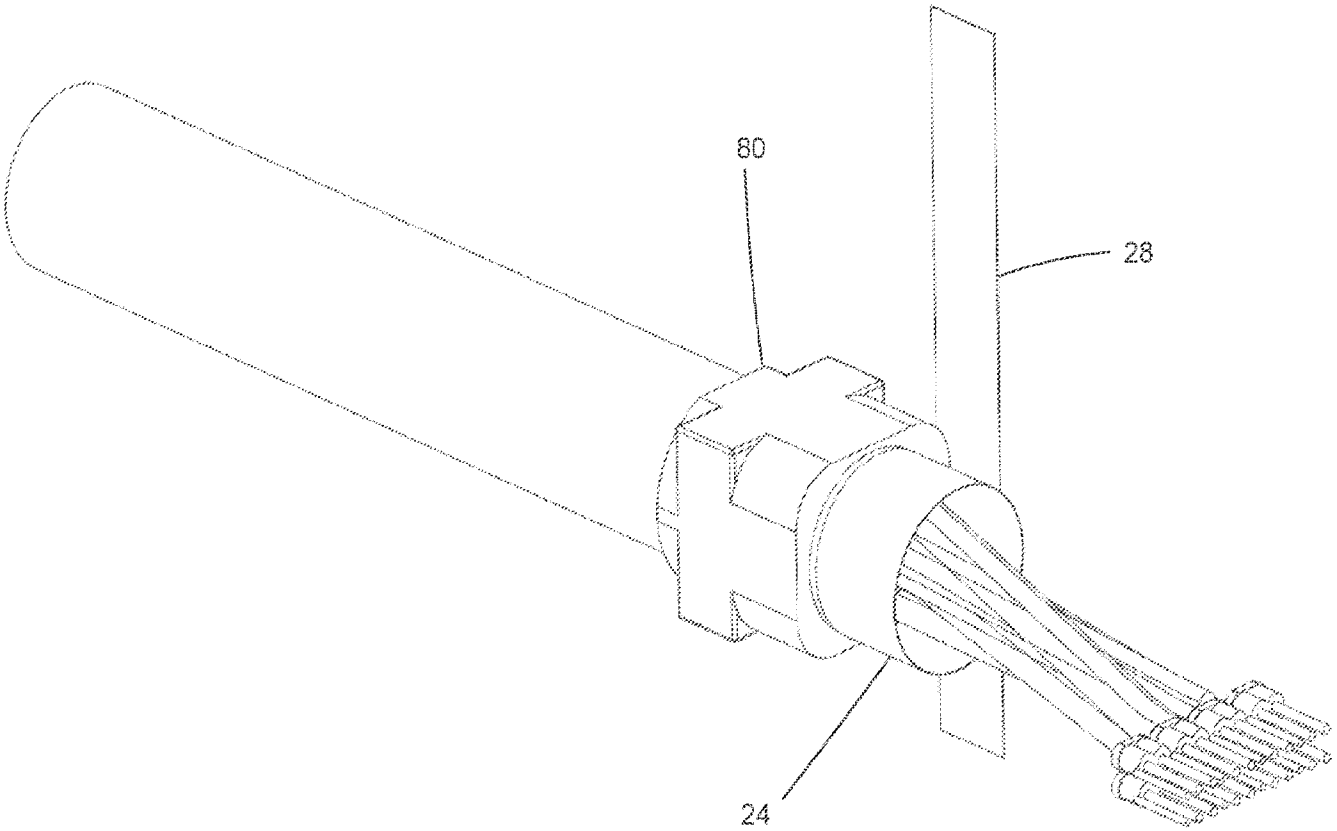
FIG. 6 is a perspective view of an alternate embodiment of the conductive cable with strain relief.
Figure 7:
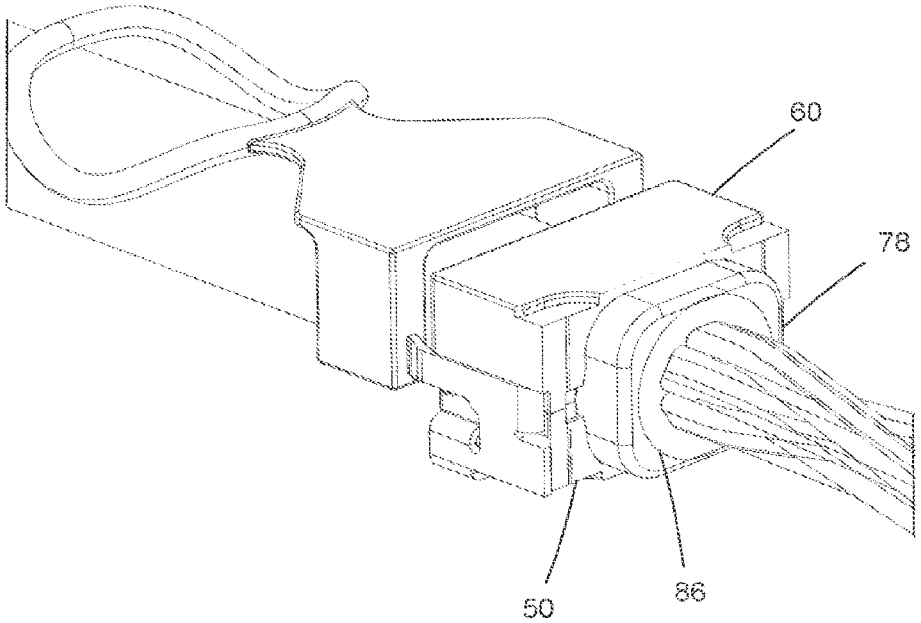
FIG. 7 is a detail view of the strain relief portion of the cable connector of FIG. 1.
Figure 8:
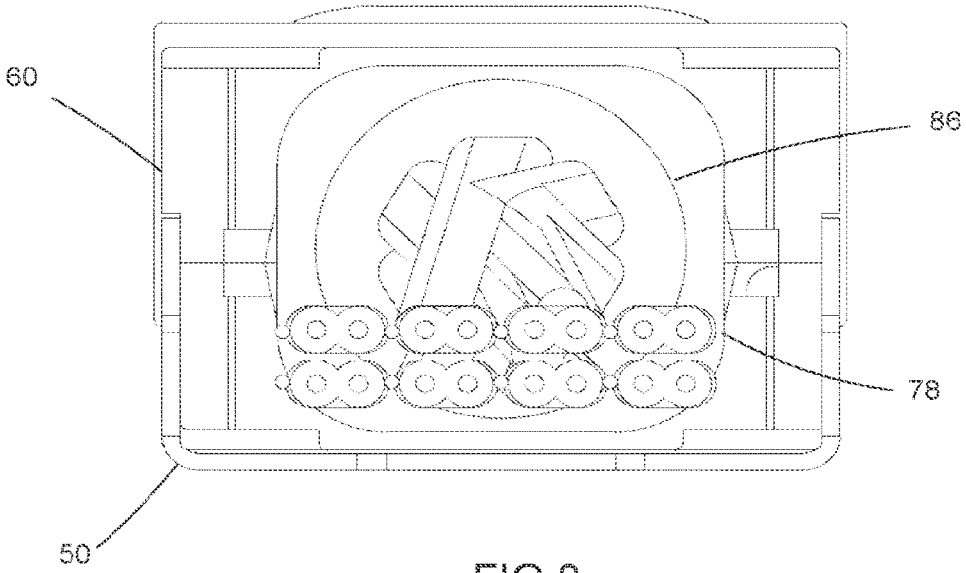
FIG. 8 is an elevation view of the strain relief portion of FIG. 7.

Once the cable assembly 20 is provided, the cable assembly 20 is prepared to be coupled to the housing 50 and the cover 60. As best illustrated in FIGS. 4-9, the preparation of the cable assembly 20 includes removing a portion of the outer jacket 22 of the cable bundle thereby exposing a section of the shielding layer 24 where, in the embodiment shown, the shielding layer 24 is a conductive braid 86. The end of the cable assembly 20 that has been dressed is then placed into a mold and a slug 80 is molded from an electrically conductive material around that portion of the cable assembly 20, thereby creating a conductive strain relief section and an electrical path between the shielding layer 26 of the cable assembly 20 and the shield layer 26 of each individual differential pair signal conductor 82. In an alternative embodiment, as shown in FIG. 6 the material forming the strain relief may be an insulative material and include a foil tape 28 or other conductive layer to maintain an electrical path between the shield layer 26 and the exterior of the strain relief. In this embodiment, once the slug 80 is molded to the cable assembly 29, the shield layer 26 is folded over the slug 80 and the conductive tape 28 is secured around the shield layer 26 and the slug 80.

During the molding process, molten plastic is injected into the mold that flows over and around the portion of the cable that is inserted into the mold that includes the exposed braid 86, and the electrically conductive material penetrates the braid 86 and fuses to the braid 86 maintaining intimate electrical contact with the braid 86 at a ground connection portion 78. In other words, the molten plastic gets dispersed between the individual metallic fibers of the braid 86 essentially creating a matrix of the metallic fibers of the braid 86 and the conductive plastic body of the slug 80.

Also shown in FIG. 3, a circuit board 100 is also provided wherein the circuit board 100 includes a plurality of contact pads 104 disposed on the first end 102 of the circuit board 100 configured to engage corresponding electrical terminals of the mating connector (not shown). The circuit board 100 also includes contact pads 108 at the second end 106 that provide an area to secure the individual conductors 83 of each differential pair cable conductor to the circuit board 100. The exposed ends 85 of the conductors 83 are such that they can be secured to appropriate contact pad portions 108 formed on the circuit board 100, typically by soldering or welding. An epoxy layer is disposed over the soldered conductor portions of the differential pair signal conductors and contact pads to provide a strain relief between the signal conductors and the circuit board 100.

Additionally, the exterior member or mounting area 76 of the slug 80 is configured to correspond to the shape of a pocket 56, 57 formed at an entry portion 74 of the housing 50 and cover 60. Upon securing the cover 60 to the housing, the slug 80 is secured and contained within the pocket 56. The slug 80 provides an electrically conductive path between the braid 86 of the cable to the housing assembly upon assembly.

The cable 20 is then positioned in the housing 50 with the attached circuit board 100 and the cover 60 is secured thereto. As best shown in the section views of FIGS. 7 and 8, the ground connection portion 78 of the slug is sandwiched between the housing 50 and cover 60. The slug 80 and the insert molded braid 86 are in direct contact with the housing 50 and cover 60 creating a secure ground connection between the cable 20 and the housing 50 and cover 60. Additionally, the circuit board 100 is fitted into a corresponding pocket and aligned to the housing 50 and cover 60 providing for proper engagement with the mating connector.

As further illustrated in FIGS. 9-12 the mounting area 76 is configured to interlock with a corresponding pocket 56 formed in the housing 50 and cover 60. The fit between the slug 80 and the pocket 56 secures the slug 80 and cable 20 to the housing 50 and cover 60 and also maintains electrical contact between the slug 80 and the housing 50 and cover 60. In this arrangement, any forces applied to the cable 20 are transferred from the cable 20 to the housing 50 and cover 60 of the plug connector 10 thereby removing any forces that can be generated between the individual conductors of the cable and the connection to the circuit board 100.

Figure 9:
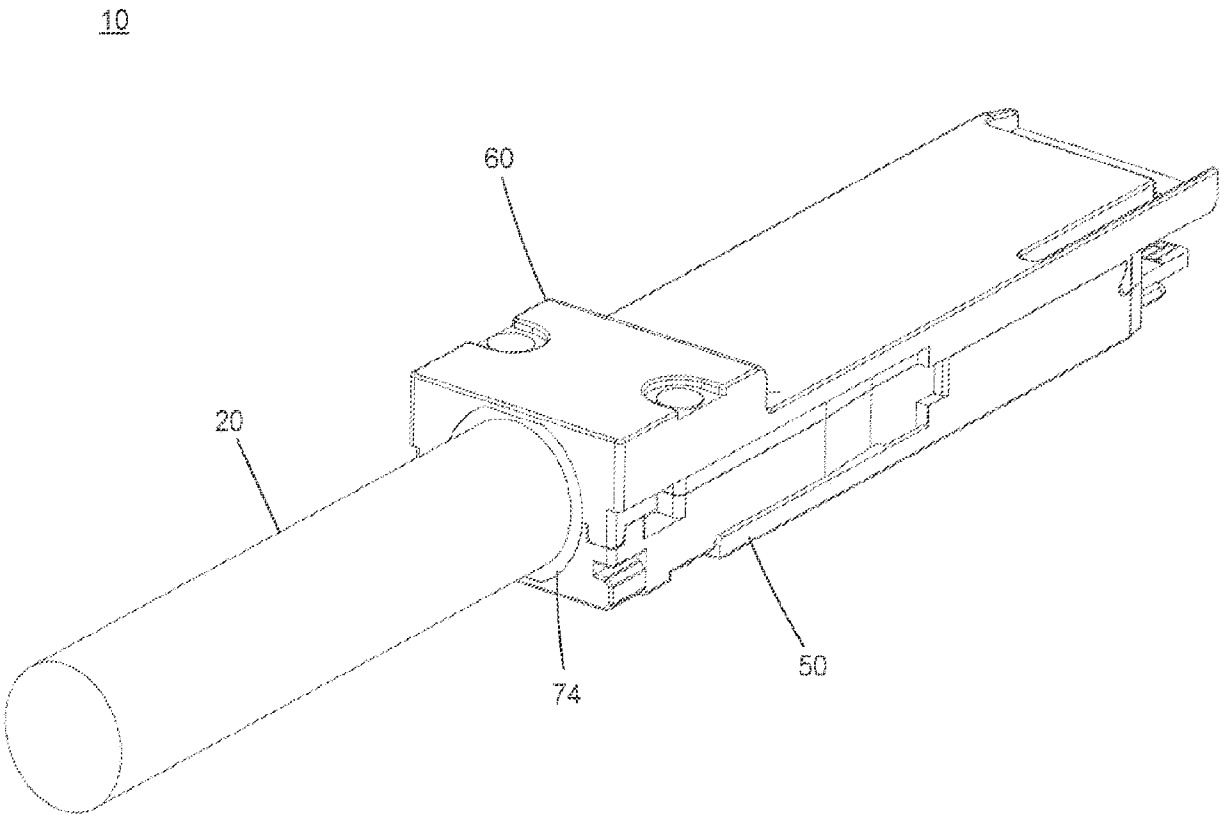
FIG. 9 is an alternative perspective view of the cable connector of FIG. 1.
Figure 10:
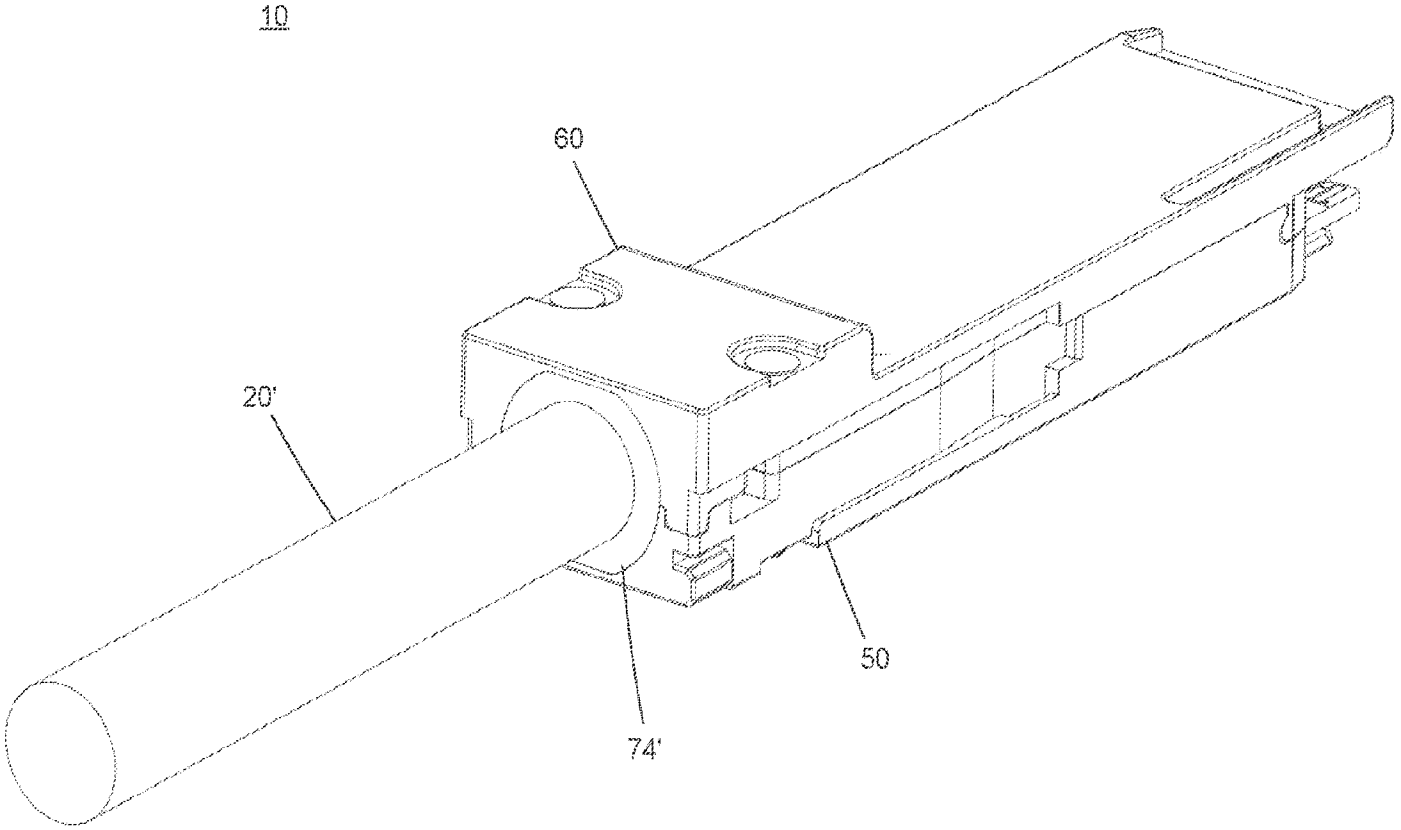
FIG. 10 is another embodiment of the cable connector of FIG. 1.
Figure 11:
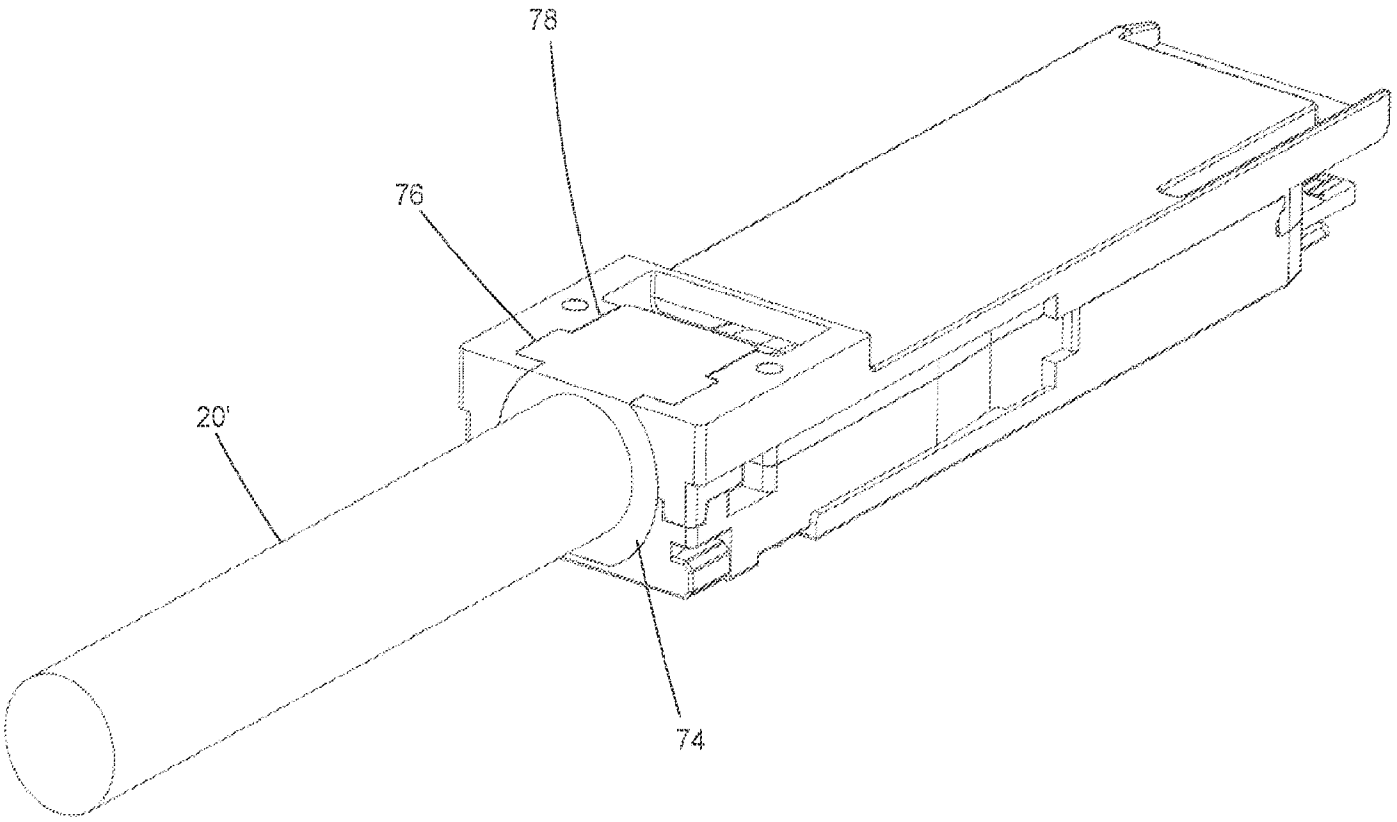
FIG. 11 is a partial sectional view of the cable connector of FIG. 10 illustrating the strain relief.
Figure 12:
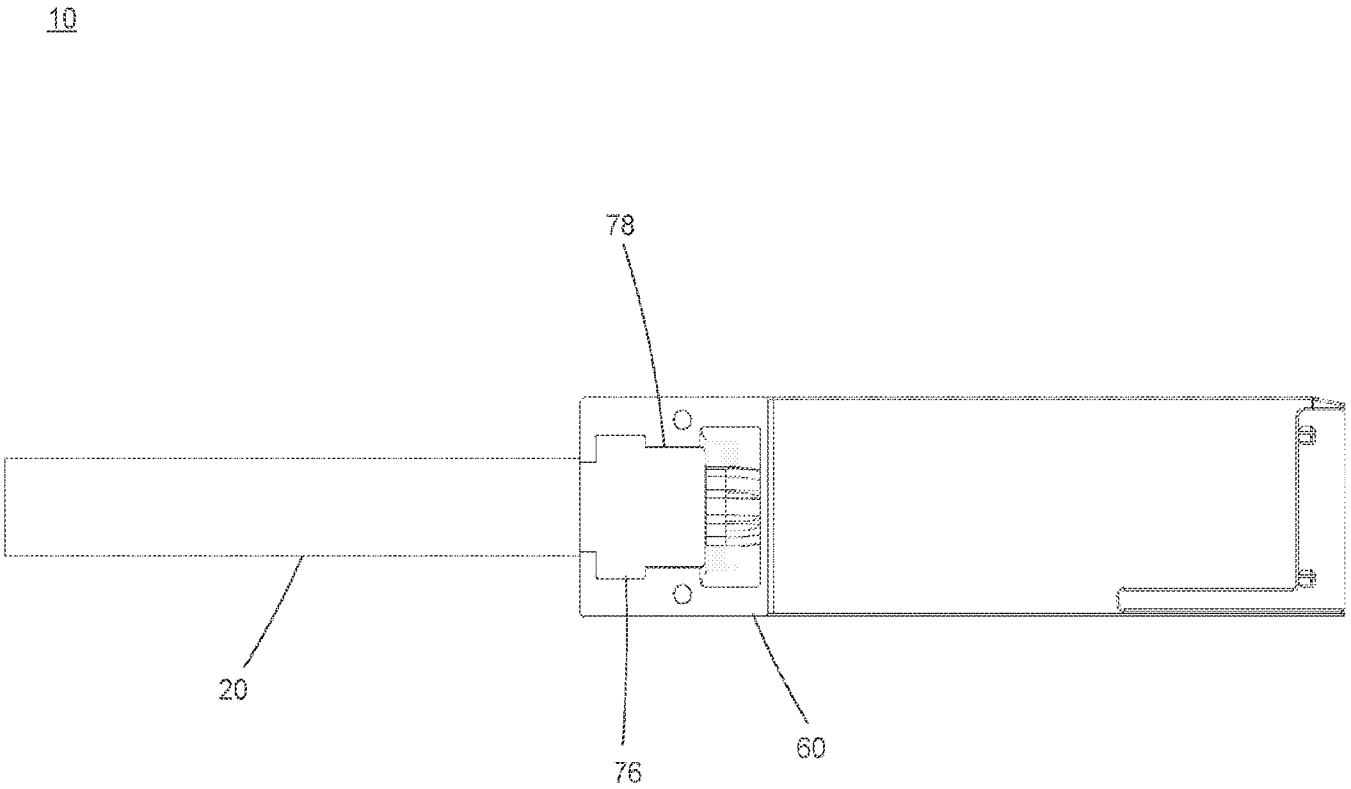
FIG. 12 is a top sectional view of the cable connector of FIG. 11.

As further illustrated in FIGS. 9-10, the slug 80 has a constant exterior geometry, that is, the exterior shape of the slug 80 remains constant and therefore the pocket 56 formed in the housing 50 and cover 60 also remains constant. The cable 20 and associated individual cable portions can be of various sizes and configurations depending on their intended usage. Namely, cables may vary in conductor size. In these instances, different slugs are required. In the embodiment shown, a slug 80 having a single exterior geometry is used and can be molded around different cables 20. Specifically shown in FIGS. 9-10, the outside diameter of the cable varies, but the same exterior slug geometry is maintained. In this arrangement the same housing 50 and cover 60 are also used, therefore reducing the number of different housing/cover and strain relief exterior geometry configurations.

It will be understood that there are numerous modifications of the illustrated embodiments described above which will be readily apparent to one skilled in the art, such as many variations and modifications of the compression connector assembly and/or its components including combinations of features disclosed herein that are individually disclosed or claimed herein, explicitly including additional combinations of such features, or alternatively other types of contact array connectors. Also, there are many possible variations in the materials and configurations.

We claim:

1. A method, comprising:

providing a housing that comprises a cavity having a first pocket;

providing a circuit board and a cable assembly, the cable assembly comprising a cable, the circuit board having a mating end and a mounting end positioned opposite the mating end with first contact pads formed at the mating end and second contact pads positioned at the mounting end, the cable comprising conductors terminated to the second contact pads, the cable further comprising a shielding layer having an exposed section;

providing a slug formed of an electrically conductive material, the slug molded on the exposed section of the shielding layer of the cable in electrical contact therewith, and configured to be positioned in the first pocket;

positioning the circuit board and the cable assembly in the housing; and mounting a cover on the housing so that the cover and housing wrap around four sides of the circuit board, the cover adapted to be connected to the housing, the cover having a second pocket formed therein, wherein the first pocket and the second pocket are configured to engage the slug, wherein the slug provides an electrical connection between the housing and the cover.

2. The method of claim 1, wherein the slug engages the shielding layer when molded on the cable, thereby creating an electrical path between the shielding layer and a shield layer of individual differential pair signal conductors of the cable.

3. The method of claim 1, wherein the slug comprises a projection and one of the first pocket and second pocket comprises a shoulder formed therein and the step of positioning the circuit board and cable assembly in the housing causes the projection to be aligned with the shoulder so that when the cover is mounted on the housing, the shoulder engages the projection and limits movement in at least one direction.

4. The method of claim 1, wherein the providing of the circuit board and cable assembly comprises forming an epoxy layer over the conductors and the second contact pads.

5. The method of claim 1, wherein the housing and the cover define a front face and the circuit board mating end extends past the front face.

6. The method of claim 5, wherein one of the housing and the cover comprises a flange that extends along so as to at least partially cover the mating end.

7. The method of claim 1, further comprising positioning a locking member in the housing, the locking member configured to move relative to the housing.

8. The method of claim 1, wherein the cable further comprises an insulator surrounding the conductors, and the shielding layer surrounds the conductors and the insulator.

9. The method of claim 1, wherein the cable further comprises an insulative jacket forming an exterior layer of the cable, wherein the shielding layer is exposed through a removed portion of the insulative jacket.

10. A cable assembly, comprising:

a housing comprising a cavity having a first pocket;

a circuit board and a cable assembly having a cable, the circuit board having a mating end and a mounting end positioned opposite the mating end with first contact pads formed at the mating end and second contact pads positioned at the mounting end, the cable comprising conductors terminated to the second contact pads, and a shielding layer having an exposed section;

a slug formed of an electrically conductive material molded on the exposed section of the shielding layer of the cable and in electrical connection therewith, and configured to be positioned in the first pocket, wherein the circuit board and the cable assembly are positioned in the housing; and a cover positioned on the housing, the cover and the housing collectively wrapping around four sides of the circuit board, the cover adapted to be connected to the housing, the cover having a second pocket formed therein, wherein the first pocket and the second pocket are configured to engage the slug, wherein the slug provides an electrical connection between the housing and the cover.

11. The cable assembly of claim 10, wherein the slug engages the shielding layer as molded on the cable, thereby creating an electrical path between the shielding layer and a shield layer of individual differential pair signal conductors of the cable.

12. The cable assembly of claim 10, wherein the slug comprises a projection, one of the first pocket and the second pocket comprises a shoulder formed therein, and the projection is aligned with the shoulder so that when the cover is mounted on the housing, the shoulder engages the projection and limits movement in at least one direction.

13. The cable assembly of claim 10, further comprising an epoxy layer formed over the conductors and the second contact pads.

14. The cable assembly of claim 10, wherein the housing and the cover define a front face and the circuit board mating end extends past the front face.

15. The cable assembly of claim 14, wherein one of the housing and the cover comprises a flange that extends along so as to at least partially cover the mating end.

16. The cable assembly of claim 10, further comprising a locking member positioned in the housing, the locking member configured to move relative to the housing.

17. The cable assembly of claim 10, wherein the cable further comprises an insulator surrounding the conductors, and the shielding layer surrounds the conductors and the insulator.

18. The cable assembly of claim 10, wherein the cable further comprises an insulative jacket forming an exterior layer of the cable, wherein the shielding layer is exposed through a removed portion of the insulative jacket.

* * * * *